US008469037B2

(12) United States Patent
Liu et al.

(10) Patent No.: US 8,469,037 B2
(45) **Date of Patent: *Jun. 25, 2013**

(54) PRE-PORTIONED MOIST PRODUCT AND METHOD OF MAKING

(75) Inventors: Shengsheng Liu, Richmond, VA (US); Munmaya K. Mishra, Manakin Sabot, VA (US); William R. Sweeney, Richmond, VA (US); Feng Gao, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 945 days.

This patent is subject to a terminal disclaimer.

(21) Appl. No.: 12/367,192

(22) Filed: Feb. 6, 2009

(65) Prior Publication Data

US 2009/0301505 A1 Dec. 10, 2009

Related U.S. Application Data

(60) Provisional application No. 61/006,984, filed on Feb. 8, 2008.

(51) Int. Cl.
*A24B 15/00* (2006.01)

(52) U.S. Cl.
USPC ..... 131/352; 131/347

(58) Field of Classification Search
USPC ..... 131/347, 352, 359; 424/751; 426/89, 426/96; 427/4
See application file for complete search history.

(56) References Cited

U.S. PATENT DOCUMENTS

| | | | | |
|---|---|---|---|---|
| 865,026 | A | 11/1907 | Ellis | |
| 904,521 | A | 11/1908 | Ellis | |
| 1,376,586 | A | 5/1921 | Schwartz | |
| 4,513,756 | A | 4/1985 | Pittman et al. | |
| 4,543,370 | A | 9/1985 | Porter et al. | |
| 4,545,392 | A | 10/1985 | Sensabaugh, Jr. et al. | |
| 4,624,269 | A | 11/1986 | Story et al. | |
| 4,683,256 | A | 7/1987 | Porter et al. | |
| 4,817,640 | A | 4/1989 | Summers | |
| 4,917,161 | A | 4/1990 | Townend | |
| 4,975,270 | A | 12/1990 | Kehoe | |
| 5,092,352 | A | 3/1992 | Sprinkle, III et al. | |
| 5,175,277 | A | 12/1992 | Rakitsky et al. | |
| 5,387,416 | A | 2/1995 | White et al. | |
| 5,795,606 | A * | 8/1998 | Lapre et al. | 426/302 |
| 6,162,516 | A | 12/2000 | Derr | |
| 6,325,859 | B1 | 12/2001 | De Roos et al. | |
| 7,032,601 | B2 | 4/2006 | Atchley et al. | |
| 2003/0224090 | A1 | 12/2003 | Pearce et al. | |
| 2004/0118421 | A1 | 6/2004 | Hodin et al. | |
| 2004/0118422 | A1 * | 6/2004 | Lundin et al. | 131/352 |
| 2004/0247649 | A1 | 12/2004 | Pearce et al. | |
| 2004/0247744 | A1 | 12/2004 | Pearce et al. | |
| 2004/0247746 | A1 | 12/2004 | Pearce et al. | |
| 2005/0003048 | A1 | 1/2005 | Pearce et al. | |
| 2005/0061339 | A1 | 3/2005 | Hansson et al. | |
| 2005/0067726 | A1 | 3/2005 | Yan et al. | |
| 2005/0100640 | A1 | 5/2005 | Pearce | |
| 2005/0244521 | A1 | 11/2005 | Strickland et al. | |
| 2006/0073190 | A1 | 4/2006 | Carroll et al. | |
| 2006/0144412 | A1 | 7/2006 | Mishra et al. | |
| 2006/0191548 | A1 | 8/2006 | Strickland et al. | |
| 2007/0003663 | A1 | 1/2007 | Jani et al. | |
| 2007/0012328 | A1 | 1/2007 | Winterson et al. | |
| 2007/0062549 | A1 | 3/2007 | Holton, Jr. et al. | |
| 2007/0122455 | A1 | 5/2007 | Myers et al. | |
| 2007/0186844 | A1 | 8/2007 | Weisleder et al. | |
| 2007/0186941 | A1 | 8/2007 | Holton, Jr. et al. | |
| 2007/0186942 | A1 | 8/2007 | Strickland et al. | |
| 2007/0186943 | A1 | 8/2007 | Strickland et al. | |
| 2007/0186944 | A1 | 8/2007 | Strickland et al. | |
| 2007/0190157 | A1 | 8/2007 | Sanghvi et al. | |
| 2008/0029110 | A1 | 2/2008 | Dube et al. | |
| 2008/0029116 | A1 | 2/2008 | Robinson et al. | |
| 2008/0029117 | A1 | 2/2008 | Mua et al. | |
| 2008/0081071 | A1 | 4/2008 | Sanghvi et al. | |
| 2008/0173317 | A1 | 7/2008 | Robinson et al. | |
| 2008/0202533 | A1 | 8/2008 | Mishra et al. | |
| 2009/0038631 | A1 | 2/2009 | Mishra et al. | |
| 2009/0301505 | A1 | 12/2009 | Liu et al. | |

FOREIGN PATENT DOCUMENTS

| | | | |
|---|---|---|---|
| WO | WO 03/053175 | A | 7/2003 |
| WO | WO 2006004480 | | 1/2006 |
| WO | WO 2006065192 | | 6/2006 |
| WO | WO 2006105173 | | 10/2006 |
| WO | WO 2008059375 | A | 5/2008 |

OTHER PUBLICATIONS

International Search Report and Written Opinion dated Sep. 17, 2008 for PCT/IB2007/004216.
International Preliminary Report on Patentability issued Feb. 9, 2010 for PCT/IB2008/002883.
International Search Report and Written Opinion dated Mar. 30, 2009 for PCT/IB2008/002883.
International Preliminary Report on Patentability and Written Opinion dated May 19, 2009 for PCT/IB2007/004216.
International Search Report and Written Opinion mailed Aug. 25, 2009 for PCT/IB2009/000385.
U.S. Appl. No. 12/576,986, filed Oct. 9, 2009.
U.S. Appl. No. 12/790,043, filed May 28, 2010.
International Preliminary Report on Patentability issued Aug. 10, 2010 for International Application No. PCT/IB2009/000385.
U.S. Appl. No. 12/748,272, filed Mar. 26, 2010.

* cited by examiner

*Primary Examiner* — Richard Crispino
*Assistant Examiner* — Dionne W Mayes
(74) *Attorney, Agent, or Firm* — Buchanan Ingersoll & Rooney PC

(57) ABSTRACT

A pre-portioned moist product comprising a portion of plant material and a coating is disclosed. Preferably, the plant material comprises tobacco. The coating includes a soluble, non-cross-linkable component and an cross-linkable component which becomes substantially water-insoluble upon crosslinking. The soluble component of the coating dissolves upon placement in the mouth, while the insoluble component disintegrates and/or loses structural integrity once the soluble component has dissolved to release and disperse the plant material in the user's mouth.

18 Claims, 1 Drawing Sheet

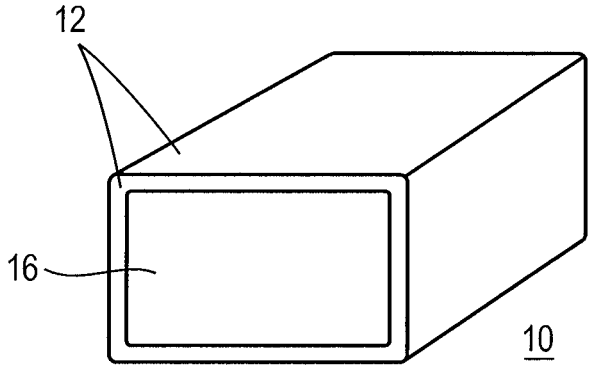
12
16
10

PRE-PORTIONED MOIST PRODUCT AND METHOD OF MAKING

CROSS REFERENCE TO RELATED APPLICATION

This application claims priority under 35 U.S.C. §119(e) to U.S. provisional Application No. 61/006,984, filed on Feb. 8, 2008, the entire content of which is incorporated herein by reference.

SUMMARY

Provided is a pre-portioned, product that is a collection of particles of a plant material that is at least partially enclosed by a coating, which coating is prepared by placing a pre-portioned shaped mass of the plant material in an aqueous coating solution which includes one or more water-soluble, non-cross-linked components in an amount of about 15% to about 30% by weight based on the weight of the coating solution and one or more substantially water-insoluble, cross-linked components in an amount of about 0.3% to about 1.5% by weight based on the weight of the coating solution. Preferably, the plant material includes a tobacco material, such as moist smokeless tobacco. The coating may also contain a tobacco material. Once placed in the mouth, the soluble, non-cross-linked component dissolves. The insoluble, cross-linked component is insufficient to hold the particles of plant material together, so that the plant material is released and/or dispersed in loose form in a user's mouth. The result is a pre-portioned moist plant material product which has sufficient structural integrity to be handled and inserted into the mouth by the user, but which breaks up after insertion in the user's mouth, to replicate the experience of using a moist plant material product, such as loose moist smokeless tobacco.

In another embodiment is provided a method of forming a pre-portioned product for oral enjoyment having a semi-dissolvable coating, the method comprising: forming a portion of plant material particles to form a pre-portioned plant material; contacting said portion of pre-portioned plant material with a multi-component coating solution comprising a water-soluble, non-cross-linkable polymer included in an amount of about 15% to about 30% by weight based on the weight of the coating solution and a cross-linkable polymer which forms a substantially water-insoluble polymer upon cross-linking included in an amount of about 0.3% to about 1.5% by weight, based on the weight of the coating solution, to form a coating on said portion of moist plant material; and cross-linking said cross-linkable polymer to form a semi-dissolvable, coating on the surface of the pre-portioned plant material.

BRIEF DESCRIPTION OF THE DRAWINGS

FIG. 1 is a cross-sectional view of one embodiment of a tobacco product with a coating.

DETAILED DESCRIPTION

It will be understood that any embodiments described herein with respect to tobacco can be extended to other plant materials by replacing all or some of the particulate tobacco material with the other particulate plant material, and making such other changes as may be necessary to achieve the desired result of a coated, pre-portioned product having sufficient structural integrity for easy handling and manipulation, while rapidly and thoroughly disintegrating in the user's oral cavity.

As described herein, a moist tobacco product has been developed wherein a coating surrounds a molded shape of moist tobacco. It has been found that some coatings of moist smokeless tobacco exhibit various drawbacks with respect to flavor release and/or ability to contain moist smokeless tobacco. For instance, it has been determined that some coating materials are not comfortable in a user's mouth, while others provide too rapid a flavor release or too much moisture.

To help overcome drawbacks such as these, the coating described herein has been developed, which allows the flow of flavor juices from the moist smokeless tobacco, as well as any added flavors, into the user's oral cavity. The product described herein also allows for the formation of a pre-portioned tobacco product that is easily placed in the mouth, but which breaks up into individual particles once the non-cross-linked components of the coating dissolve on exposure to the user's saliva.

As used herein, the term "pre-portioned" describes tobacco or other plant material that has been molded or divided into individual servings prior to use, such that the pre-portioned tobacco can be placed in a user's mouth without the need for the user to determine an amount to use. It is intended to include collections of plant material particles that have been pressed or molded or otherwise formed into one or more shapes that are convenient for a user to recognize, manipulate, and/or comfortably insert into the oral cavity and consume, and which contain an amount of plant material similar to that commonly used by users of moist smokeless products. The terms "pre-portioned plant material" or "pre-portioned tobacco material" as used herein refers to the plant material and/or tobacco exclusive of the coating. The term "pre-portioned product" as used herein refers to the coated product as a whole, i.e., to the pre-portioned plant material or pre-portioned tobacco material, and its coating.

As used herein, the terms "particle" or "particles" denote any subdivided form of plant material, and can include flakes, granules, powders, chopped stems, leaves, flowers, or other pieces of a plant material, and in a particular embodiment, of tobacco.

As used herein, the term "substantially water-insoluble" denotes a material that has a significantly lower solubility in water than the non-cross-linked water-soluble polymers described herein.

FIG. 1 illustrates a cross-sectional view of an embodiment of a pre-portioned product 10 with a coating 12. The coating 12 is a single layer, multicomponent coating that coats a pre-portioned amount of plant material 16. The multicomponent coating 12 includes a soluble polymer and an insoluble polymer, which may be the same or different polymer. Plant material 16 is a collection of plant material particles that have been formed into a suitable size and/or shape. Preferably, the plant material 16 is a molded portion of moist smokeless tobacco of a size suitable for consumption by an individual.

Preferably, the pre-portioned product 10 is sized and configured to fit comfortably between the user's cheek and gum. The pre-portioned product 10 may be formed in many shapes including, without limitation, spheres, rectangles, oblong shapes, crescent shapes, ovals, and cubes. In a preferred embodiment, the pre-portioned product is rectangular and weighs about 1.0 g. to about 3.5 g, more particularly about 2.5 g to 3.0 g (e.g., about 2.6 g to about 2.9 g or about 2.7 g to about 2.8 g).

In a preferred embodiment, a coating 12 is prepared from a multicomponent polymer solution (coating solution). The pre-portioned amount of moist plant material can be enclosed by the coating by applying to at least some of the outer surface of the portion a polymer solution including at least two polymers (and which may include, e.g., at least three polymers or at least four polymers). At least one polymer of the coating solution is a water-soluble, non-cross-linkable polymer, which dissolves in the mouth. At least one other polymer in the coating solution is a water-soluble, cross-linkable polymer which becomes substantially water-insoluble after crosslinking. The polymer coating may be applied to the moist pre-portioned plant material by a variety of techniques, which can include dipping, spraying, and the like. The coated pre-portioned plant material is then contacted with a cross-linking agent suitable for the cross-linkable polymer or polymers employed in the coating. This contact can result from application of the cross-linking agent to the coated portion, e.g., by spraying, dipping, or other application of a solution of cross-linking agent to the coated portion (resulting in an "outside-in" direction of cross-linking). Alternatively, cross-linking can result from contact of the cross-linkable polymer with cross-linking agent already present in the plant material, either as the result of cross-linking agent present in the plant material before it is formed into a pre-portion, or as the result of the application of cross-linking agent to the pre-portion prior to application of the polymer coating.

The resulting coating desirably contains a minority amount of the substantially water-insoluble, cross-linked polymer, which minority amount is insufficient for the pre-portion to retain its structural integrity in the user's mouth after the water-soluble, non-cross-linked component has dissolved. Thus, the particles of plant material 16 contained within the coating 12 are released and/or dispersed in the user's mouth once the water-soluble component dissolves and the pre-portioned form disintegrates.

The resulting coating is preferably in the form of a gel, more particularly in the form of a hydrogel. As a result, in addition to the polymers, cross-linking agents, and any additives, such as preservatives, flavorants, etc., a significant portion of the weight of the coating is water. Because only the water-soluble, non-cross-linked component of the coating dissolves and releases moisture into the user's mouth, the amount of moisture released is controlled, and is not excessive. This provides the user with decreased slipperiness and improved mouthfeel when using the product.

Preferably, the water-soluble, non-cross-linked component dissolves rapidly in a user's mouth. In a preferred embodiment, the soluble component dissolves in about 0.1 seconds to about 10 seconds (e.g., about 1 second to about 9 seconds, about 2 seconds to about 8 seconds, about 3 seconds to about 7 seconds or about 4 seconds to about 6 seconds) after introduction into the oral cavity. Also preferably, the pre-portioned form loses its structural integrity within about 5 to about 15 seconds (e.g., about 6 to about 14 seconds, about 7 to about 13 seconds, about 6 to about 12 seconds, about 7 to about 11 seconds or about 8 to about 10 seconds) after introduction into the oral cavity.

Preferably, the water-soluble component is formed by a non-cross-linked and/or non-crosslinkable polymer. In an embodiment, the water-soluble component can be formed by a cross-linkable polymer, which has not reacted with a cross-linking agent. Preferably, the coating includes the water-soluble, non-cross-linkable polymer in an amount of about 15% to about 30% by weight based on the weight of the coating solution. If less than 15% water-soluble component is used, the pre-portioned product will retain too much structural integrity, and will break up into large chunks upon dissolution of the water-soluble, non-cross-linked polymer because portions of the coating will be too strong. If more than 30% of the coating is the water-soluble non-cross-linked polymer, the pre-portioned product will have insufficient structural integrity to allow a user to handle it while placing it in the mouth.

Also preferably, the substantially water-insoluble component is formed by a chemically cross-linkable polymer reacted with a cross-linking agent. Preferably, the coating includes the substantially water-insoluble component in an amount of about 0.3% to about 1.5% by weight based on the weight of the coating solution. If a coating containing less than about 0.3% substantially water-insoluble component is used, the pre-portioned product will be too weak for a user to handle when placing in the mouth, and will break apart. If a coating containing more than about 1.5% substantially water insoluble component is used, the coating will provide too much structural integrity to the product, which will not break apart and disperse the tobacco material properly in the user's mouth.

The polymers of the water-soluble component and substantially water-insoluble component may be natural or synthetic. Preferably the polymers are hydrocolloids. More preferably, the polymers are polysaccharides.

Suitable non-chemically-cross-linkable polymers include, without limitation, starch and starch derivatives, such as modified starch, dextrin, gums, such as gum arabic, guar gum, xanthan gum, locust bean gum, curdlan gum, gellan gum, fenugreek derivative gums, pullulan, chitosan, chitin, cellulose and cellulose derivatives, synthetic polymers, such as polyvinyl alcohol, polylactide, polyethylene glycol, polyvinylpyrrolidone, or polyvinylacetate, and soluble or insoluble vegetable fiber.

Suitable chemically cross-linkable polymers include, without limitation, alginate, pectin, carrageenan, and modified polysaccharides with cross-linkable functional groups. Preferred cross-linkable polymers are pectins and alginates.

In a preferred embodiment, the cross-linking agent is a polyvalent metal salt, more particularly, a monovalent metal ion salt or bivalent metal ion salt. While, both monovalent and bivalent metal ion salts may be used, a bivalent metal ion salt is particularly suitable for crosslinking certain polysaccharides, such as pectins. Suitable cross-linking agents include, without limitation, calcium lactate, calcium chloride, calcium lactobionate, tricalcium phosphate, calcium glycerophosphate, calcium hexametaphosphate, calcium acetate, calcium carbonate, calcium bicarbonate, calcium citrate, calcium gluconate, sodium chloride, sodium lactate, sodium acetate, sodium carbonate, sodium bicarbonate, sodium citrate, sodium gluconate, potassium chloride, potassium lactate, potassium acetate, potassium carbonate, potassium bicarbonate, potassium citrate, potassium gluconate and combinations of these.

The amount of cross-linking agent used will depend to a large extent on the amount of cross-linkable polymer included in the coating mixture. For the preferred amounts of cross-linkable polymers disclosed herein, preferably, the cross-linking agent is included in the coating in an amount of about 0.5 wt % to about 2.0 wt %, based on the total weight of the cross-linking solution, more preferably about 0.5 wt % to about 1.5 wt %. Using less than 0.5 wt % cross-linking agent will generally not provide enough cross-linking agent to react with the amounts of cross-linkable polymer included in the coating mixture, which tends to result in a weak coating that will not provide the pre-portioned product with sufficient structural integrity for user handling when retrieving the product and positioning it in the oral cavity. Using more than about 2.0 wt % is unnecessary due to the low amount of cross-linkable polymer present, thereby adding unnecessary cost to the product, and may adversely affect the flavor of the product.

Alternatively, proteins, such as gelatin, zein, soy protein, rice protein, and whey protein, can be used to supplement or replace the cross-linkable polymers that are cross-linked with monovalent and bivalent metal ion salts. The proteins slowly cross-link with phenolics and/or aldehydes that are naturally occurring in plant material.

Once the water-soluble component of the coating dissolves flavors and water are released into the user's mouth and the pre-portioned product loses its structural integrity so that the plant material enclosed by the coating is released. The pre-portioned product thus provides both rapid flavor release and a replication of the experience of using loose moist smokeless tobacco very soon after insertion into the user's oral cavity.

In addition, due to the presence of relatively small amounts of water-soluble component, excess water and juice are not released upon disintegration of the pre-portioned product. The combination of polymers in the coating, in the ranges disclosed herein, provides a soft compliant feel to the tongue and mouth tissues, and dissolves quickly, so that the sensory experience associated with moist tobacco use is rapid and unencumbered. In addition, because only small quantities of the substantially water-insoluble cross-linked polymer remain on a small quantity of the plant material (i.e., only that quantity of plant material that was actually in contact with the coating) after the pre-portioned product has disintegrated in the user's mouth, the plant material that disperses is essentially uncoated. When this plant material is tobacco, the resulting sensory experience replicates more closely what user's expect from moist smokeless tobacco than would a product where the individual particles have been coated.

In a preferred embodiment, the coating is not messy or sticky to the touch. Because at least two polymers are used to create the coating, when a user touches the coating, the polymers do not disassociate from one another. Therefore, the coating is not sticky when the product is removed from a package and placed in the mouth.

Preferably, the pre-portioned product weighs about 1.0 to 3.0 grams, and more preferably about 2.0 to about 2.5 grams. The weight is predominately based on the amount of tobacco or other plant material used since the weight of the coating is small as compared to that of the tobacco or plant material. In an embodiment, the pre-portioned product may be up to about 1.5 inches long, up to 1 inch in height, and up to ¾ inch in width. Preferably, the pre-portioned product is flexible, compressible, and capable of conforming to the shape of the oral cavity.

In a preferred embodiment, the plant material used is or contains tobacco, and will be further described by reference to this preferred plant material. It will be understood, however, that the embodiments described below are equally applicable to other plant materials, such as tobacco substitutes.

Exemplary tobacco materials that may be coated can include cut or ground tobacco. In a preferred embodiment, the tobacco is a blend of Dark Fire-Cured and Dark Air Cured tobaccos. Additionally, flavor additives and/or humectants may be included in the tobacco material. The tobacco can have the composition and attributes of conventional moist snuff or moist smokeless tobacco.

Examples of suitable types of tobacco materials that may be used include, but are not limited to, flue-cured tobacco, Burley tobacco, Maryland tobacco, Oriental tobacco, rare tobacco, specialty tobacco, reconstituted tobacco, agglomerated tobacco fines, blends thereof and the like. Preferably, the tobacco material is pasteurized. Some or all of the tobacco material may be fermented.

The tobacco material may be provided in any suitable form, including shreds and/or particles of tobacco lamina, processed tobacco materials, such as volume expanded or puffed tobacco, or ground tobacco, processed tobacco stems, such as cut-rolled or cut-puffed stems, reconstituted tobacco materials, blends thereof, and the like. Genetically modified tobacco may also be used.

Additionally, the tobacco material may also include a supplemental amount of vegetable or plant fibers or particles, such as particles of shreds of lettuce, cotton, flax, beet fiber, cellulosic fibers, blends thereof and the like.

In one embodiment, the tobacco material is completely disintegrable so that once the water-soluble component of the coating dissolves, the substantially water-insoluble component has disintegrated and the tobacco material has disintegrated, no discernible particles remain in the user's mouth.

Humectants can also be added to the tobacco material to help maintain the moisture levels in the pre-portioned tobacco product. Examples of humectants that can be used with the tobacco material include glycerol, glycerine, triethylene glycol and propylene glycol. The humectants may also be provided for a preservative effect, as the water activity of the product can be decreased with inclusion of a humectant. In turn, the opportunity for growth of micro-organisms is diminished. Additionally, humectants can be used to provide a higher moisture feel to a drier tobacco component.

In an embodiment, the pre-portioned tobacco material 16 or the coating 12 can include one or more flavors, sweeteners, preservatives, nutraceuticals, antioxidants, amino acids, minerals, vitamins, botanical extracts and/or chemesthesis agents that can be released upon dissolution of the soluble component of the coating or upon disintegration of the insoluble component of the coating. If slow release of certain flavor additives is desired, such additives can be incorporated in the insoluble component. Preferably, the released flavors enhance the oral sensorial experience of the tobacco product user.

Suitable flavor additives and aromas for inclusion in the coating 12 or the tobacco material 16 include, but are not limited to, any natural or synthetic flavor or aroma, such as tobacco, smoke, menthol, peppermint, spearmint, bourbon, scotch, whiskey, cognac, hydrangea, lavender, chocolate, licorice, citrus and other fruit flavors, such as apple, peach, pear, cherry, plum, orange and grapefruit, gamma octalactone, vanillin, ethyl vanillin, breath freshener flavors, spice flavors such as cinnamon, clove, nutmeg, sage, anise, and fennel, methyl salicylate, linalool, jasmine, coffee, bergamot oil, geranium oil, lemon oil, and ginger oil. Other suitable flavors and aromas may include flavor compounds selected from the group consisting of an acid, an alcohol, an ester, and aldehyde, a ketone, a pyrazine, combinations or blends thereof and the like. Suitable flavor compounds may be selected, for example, from the group consisting of phenylacetic acid, solanone, megastimatrienone, 2-heptanone, benzylalcohol, cis-3-hexenyl acetate, valeric acid, valeric aldehyde, ester, terpene, sesquiterpene, nootkatone, maltol, damascenone, pyrazine, lactone, anethole, isovaleric acid, combinations thereof and the like. The flavorants can be included in the coating solution in an amount of about 0.001 wt % to about 20 wt %, and more preferably about 0.010 wt % to about 0.1 wt % (e.g., about 0.014 wt %) based on the total weight of the coating solution. When using a hydrophobic flavorant in the coating, an emulsifier can desirably also be included in the coating. The flavorant and/or emulsifier can be included in the polymer solution, which is applied to the preformed and/or pre-portioned tobacco material.

Suitable emulsifiers include, without limitation polysorbate 20, polysorbate 80 and sugar ester. The emulsifiers can be included in an amount of about 0.001 wt % to about 20 wt %, preferably about 0.1 wt % to about 2.0 wt % (e.g., about 1.0 wt %), based on the total weight of the coating solution.

The coating 12 or the pre-portioned plant material 16 may also include additives such as natural or artificial sweeteners. Preferred sweeteners include, without limitation, water soluble sweeteners, such as monosaccharides, disaccharides, and polysaccharides, such as xylose, ribose, sucrose, maltose, fructose, glucose, and mannose.

Additives such as chemesthesis agents may also be included in the coating 12 or the pre-portioned tobacco material 16. Suitable chemesthesis agents for inclusion in the coating include, without limitation, capsaicin, tannins, mustard oil, wintergreen oil, cinnamon oil, allicin, quinine, citric acid, and salt.

Suitable vitamins include, without limitation, vitamin A (retinol), vitamin D (cholecalciferol), vitamin E group, vitamin K group (phylloquinones and menaquinones), thiamine (vitamin $B_1$), riboflavin (vitamin $B_2$), niacin, niacinamide, pyridoxine (vitamin $B_6$ group), folic acid, choline, inositol, vitamin $B_{12}$ (cobalamins), PABA (para-aminobenzoic acid), biotin, vitamin C (ascorbic acid), and mixtures thereof. The amount of vitamins can be varied according to the type of vitamin and the intended user of the pre-portioned product. For example, the amount of vitamins may be formulated to include an amount less than or equal to the recommendations of the United States Department of Agriculture Recommended Daily Allowances. Absorption of the vitamins (particularly vitamin E and certain cobalamins) by the tissues of the mouth can be enhanced through the inclusion of agents that increase permeability of mucus membranes. Suitable agents includes fatty acids (e.g., oleic, palmitic and/or lauric acid).

As used herein, the term "nutraceuticals" refers to any ingredient in foods that has a beneficial effect on human health. Nutraceuticals include particular compounds/compositions isolated from natural food sources and genetically modified food sources. For example, nutraceuticals include various phytonutrients derived from natural plants and genetically engineered plants.

Suitable minerals include, without limitation, calcium, magnesium, phosphorus, iron, zinc, iodine, selenium, potassium, copper, manganese, molybdenum, chromium, and mixtures thereof. The amount of minerals incorporated into the pre-portioned product can be varied according to the type of mineral and the intended user. For example, the amount of minerals may be formulated to include an amount less than or equal to the recommendations of the United States Department of Agriculture Recommended Daily Allowances.

Suitable amino acids include, without limitation, the essential amino acids that cannot be biosynthetically produced in humans, including valine, leucine, isoleucine, lysine, threonine, tryptophan, methionine, and phenylalanine. Examples of other suitable amino acids include the non-essential amino acids including alanine, arginine, asparagine, aspartic acid, cysteine, glutamic acid, glutamine, glycine, histidine, proline, serine, and tyrosine.

In another embodiment, the pre-portioned product can include various active agents having antioxidant properties that can delay the ageing process, as food-grade ingredients. For example, the antioxidants can include: active ingredients that can be extracted from *Ginkgo biloba*, including flavonoid glycosides ("ginkgoflavonoids"), such as (iso)quercetin, kaempferol, kaempferol-3-rhamnosides, isorhamnetin, luteolin, luteolin glycosides, sitosterol glycosides, and hexacyclic terpene lactones, referred to as "ginkgolides" or "bilobalides"; the active ingredients that can be extracted from *Camellia sinensis*, such as green tea, including various "tea tannins," such as epicatechol, epigallocatechol, epigallocatechol gallate, epigallocatechol gallate, theaflavin, theaflavin monogallate A or B, and theaflavin digallate; the active ingredients that can be extracted from *Vaccinium myrtillus*, such as blueberry, including at least 15 different anthocyanosides, such as delphinidin, anthocyanosides, myrtin, epimyrtin, phenolic acids, glycosides, quercitrin, isoquercitrin, and hyperoside; the active ingredients that can be extracted from *Vinis vitifera*, such as grapes, include polyphenols, catechols, quercitrins, and resveratrols; and the active ingredients that can be extracted from *Olea europensis*, such as the leaves of olive trees, include oleuropein. Many active ingredients identified from these and other plant sources associated with the neutralization of free radicals and useful for delaying the ageing process are contemplated as suitable for inclusion in the pre-portioned tobacco material 16 or the coating 12 described herein.

Suitable botanical extracts can include the active ingredients of *Trifolium pratense*, such as purple clovers (i.e., common purple trefoils), including isoflavones or isoflavone glucosides, daidzein, genestein, formononentin, biochanin A, ononin, and sissostrin. The health-promoting properties of compounds derived from *Panax*, a genus that includes Ginseng, are well-established and may also be included in the pre-portioned product. These and other botanticals, botanical extracts, and bioactive compounds having health promoting effects are contemplated.

Suitable preservatives include, without limitation, methyl paraben, propyl paraben, sodium propionate, potassium sorbate, sodium benzoate and the like. The preservatives can be included in an amount of about 0.001 wt % to about 20 wt %, and more preferably about 0.01 wt % to about 1.0 wt % (e.g., about 0.1 wt %), based upon the total weight of the coating solution.

In one embodiment, the coating is a single layer, thin coating, having a soluble component and an insoluble component, over at least a portion of the surface of the pre-portioned plant material.

In a another embodiment, a multi-layered coating can be used, so that the properties of the coating, such as the rate of dissolution, amount of water and flavor released, and the thickness, can be controlled.

To form the coated moist tobacco product, an amount of tobacco material is shaped to create a preform, which can have any desired shape. Shaping of the tobacco material may be by molding or pressing the moist tobacco in a suitable mold or die. The tobacco material is preferably pressed or molded in a manner that does not remove moisture from the tobacco. This typically requires sufficiently light pressure to maintain a moisture content of about 50% to 55% by weight of the tobacco material. The preform is desirably large enough to provide moist tobacco in an amount similar to that typically used by users as an individual portion. Alternatively, the shaping of the tobacco material can be accomplished by continuous low shear extrusion and cutting of the shapes with or without subsequent forming and/or shaping.

In an embodiment, the tobacco material is then dipped in a polymer solution containing at least two different polymers dissolved in water. Preferably, a chemically cross-linkable polymer and a non-cross-linkable polymer are used.

Because moist smokeless tobacco naturally contains salts such as calcium ions, the calcium ions preferably cross-link with the cross-linkable polymer to form a skin or shell on the inside of the coating once the tobacco material has been contacted with the two polymer solution. Although it is possible for calcium ions from the tobacco to diffuse all the way through the coating, this can be a relatively slow process once the inner coating has formed. As a result, it is usually preferable to also expose the coating to an applied solution of cross-linking agent. This results in the formation of an outer skin or shell on the coating, and the diffusion of cross-linking agent from the relatively high concentration in the applied solution to the relatively low concentration in the coating. The inner and outer skins or shells provide a moisture barrier for the tobacco and the soluble portion of the coating, trapping moisture therein. Preferably, the shells/skins are formed of a discontinuous, cross-linkable polymer with regions of the non-cross-linkable polymer incorporated therein.

The concentration of the polymer solution, in part, determines the thickness of the coating membrane. The thickness of the coating can in turn affect how quickly the soluble component of the coating dissolves in a user's mouth. The coating is a moist, gel-like coating when formed and the moistness is preferably retained until use. Preferably, the coated tobacco product is hermetically sealed in suitable packaging to prevent moisture in the tobacco and coating from evaporating.

Preferably, the cross-linking solution contains a bivalent metal ion salt. Most preferably, the cross-linking solution includes calcium lactate, which is commonly used in the food industry. In one embodiment, the cross-linking solution is a 0.5 wt % calcium lactate solution.

After cross-linking and any necessary washing to remove excess cross-linking agent, the pre-portioned product can be exposed to air or patted dry to remove excess moisture. The pre-portioned product can be dried at elevated temperature, as long as the moisture content of the tobacco and of the coating remains relatively high. When dried, juices from the plant material (including water soluble flavors and compounds from the plant material) transfer into the gel coating and are delivered when placed in the mouth. If not dried, the coating may be watery.

In another embodiment, the polymer solution and the cross-linking solution can be patterned, overprinted, or sprayed onto the tobacco material preform to form a network having a soluble component and an insoluble component.

In an embodiment, the process may be automated. For instance, the coating step may occur via spraying the polymer solution and the cross-linking solution alternately onto a preformed portion of tobacco material 16 to create a cross-linked, thin, coating 12 of a desired thickness.

In an embodiment, tobacco-based polymers may be substituted for non-tobacco sourced materials in the coating. For example, tobacco-derived pectins may be used as the cross-linkable polymer. Flavorful tobacco compounds may be extracted from the tobacco based material in order to modify the tobacco flavor character of the initial in-mouth experience. However, such high extraction is unnecessary.

In one embodiment, additional dissolvable tobacco such as tobacco extracts or colloidal encapsulated tobacco can be added to the coating to increase the initial tobacco flavor in the first stages of the dissolution of the coating.

Fillers may be added to the coating to make the coating opaque. Colorants and/or opacifiers may also be added to alter the color of the coating.

The following examples are exemplary and are not meant to limit any aspects of the embodiments disclosed herein.

EXAMPLE 1

To form a coating, a round bottom flask is charged with 1% pectin, 1% dextrin, 0.04% alginate, and balance deionized water. The mixture is stirred and heated to about 50° C. to 100° C. to dissolve the polymers and form a coating solution. The coating solution is cooled down to room temperature and then transferred to a plastic pan. 2.5 g of moist tobacco is first molded into a tetragonal shape and then dipped into the above-described solution. A cross-linking solution of 0.5% calcium lactate in water is prepared. The coating on the moist tobacco is then cross-linked with the cross-linking solution by dipping the molded coated tobacco into the cross-linking solution. The sample is exposed in air to evaporate moisture until the weight of the coated moist tobacco product reaches about 2.5 g to 2.8 g.

EXAMPLE 2

The procedure described above in Example 1 is repeated, except that no calcium lactate solution is applied to the coated moist tobacco portion.

EXAMPLE 3

To form a coating, a round bottom flask is charged with 0.38 wt % pectin, 23 wt % dextrin and balance deionized water. The mixture is stirred and heated to about 50° C. to 100° C. to dissolve the polymers. The coating solution is cooled down to room temperature and then transferred to a plastic pan. 2.5 g of moist tobacco is first molded into a tetragonal shape and then dipped into the above-described solution. A cross-linking solution of 0.5 wt % calcium lactate in water is prepared. The coating on the moist tobacco is then cross-linked with the cross-linking solution by dipping the molded tobacco into the cross-linking solution. The sample is exposed in air to evaporate moisture until the weight of the coated moist tobacco product reaches about 2.5 g to 2.8 g.

EXAMPLE 4

To form a coating, a round bottom flask is charged with 0.38 wt % pectin, 23 wt % dextrin, 0.014 wt % wintergreen flavorant, 0.98 wt % polysorbate 20 and balance deionized water. The mixture is stirred and heated to about 50° C. to 100° C. to dissolve the polymers and form a coating solution. The coating solution is cooled down to room temperature and then transferred to a plastic pan. 2.5 g of moist tobacco is first molded into a tetragonal shape and then dipped into the above-described solution. A cross-linking solution of 0.5 wt % calcium lactate in water is prepared. The coating on the moist tobacco is then cross-linked with the cross-linking solution by dipping the molded tobacco into the cross-linking solution. The sample is exposed in air to evaporate moisture until the weight of the coated moist tobacco product reaches about 2.5 g to 2.8 g.

EXAMPLE 5

To form a coating, a round bottom flask is charged with 0.38 wt % pectin, 23 wt % dextrin, 0.014 wt % wintergreen flavorant, 0.98 wt % polysorbate 20, 0.1 wt % methyl paraben and balance deionized water. The mixture is stirred and heated to about 50° C. to 100° C. to dissolve the polymers and form a coating solution. The coating solution is cooled down to room temperature and then transferred to a plastic pan. 2.5 g of moist tobacco is first molded into a tetragonal shape and then dipped into the above-described solution. A cross-linking solution of 0.5 wt % calcium lactate in water is prepared. The coating on the moist tobacco is then cross-linked with the cross-linking solution by dipping the molded tobacco into the cross-linking solution. The sample is exposed in air to evaporate moisture until the weight of the coated moist tobacco product reaches about 2.5 g to 2.8 g.

EXAMPLE 6

The procedure described above for Example 3 is repeated, except that the coating solution is sprayed onto the molded moist tobacco portion, instead of dipping the portion in the coating solution.

EXAMPLE 7

The procedure described above for Example 3 is repeated, except that a coating solution of 15 wt % modified starch (National Starch) and 1 wt % pectin is used, and no cross-linking solution is used.

EXAMPLE 8

The procedure described above for Example 7 is repeated, except that a coating solution of 20 wt % modified starch and 1 wt % pectin is used.

EXAMPLE 9

The procedure described above for Example 8 is repeated, except that the coated portion was further coated with a coating solution of 0.38 wt % pectin and 23 wt % dextrin after coating with the modified starch solution.

EXAMPLE 10

The procedure described above for Example 3 is repeated, except that no cross-linking solution is used.

In this specification, the word "about" is often used in connection with numerical values to indicate that mathematical precision of such values is not intended. Accordingly, it is intended that where "about" is used with a numerical value, a tolerance of 10% is contemplated for that numerical value.

While the foregoing describes in detail a pre-portioned tobacco product including a coating and methods of making with reference to specific embodiments thereof, it will be apparent to one skilled in the art that various changes and modifications equivalents to the pre-portioned tobacco product including a coating and process steps may be employed, which do not materially depart from the spirit and scope of the invention. Accordingly, all such changes, modifications, and equivalents that fall within the spirit and scope of the invention as defined by the appended claims are intended to be encompassed thereby.

We claim:

1. A pre-portioned product for oral enjoyment comprising:

a collection of particles of plant material comprising moist tobacco material in the form of a molded portion having a moisture content of at least about 30%; and a coating comprising a water-soluble, non-cross-linked component; and a substantially water-insoluble, cross-linked component, wherein the coating is a single layer coating having an inner surface in contact with the tobacco material and an outer surface which is exposed to saliva and tissue in the oral cavity when placed therein.

2. The pre-portioned product of claim 1, wherein said water-soluble, non-cross-linked component is formed by a non-cross-linked polymer and wherein said non-cross-linked polymer is selected from the group consisting of starch and starch derivatives, such as modified starch, dextrin, gums, such as gum arabic, guar gum, xanthan gum, locust bean gum, curdlan gum, gellan gum, fenugreek derivative gums, pullulan, chitosan, chitin, cellulose and cellulose derivatives, synthetic polymers, such as polyvinyl alcohol, polylactide, polyethylene glycol, polyvinylpyrrolidone, or polyvinylacetate, soluble or insoluble vegetable fiber and combinations thereof.

3. The pre-portioned product of claim 1, wherein said substantially water-insoluble, cross-linked component is formed by cross-linking a cross-linkable polymer with a cross-linking agent and wherein said cross-linkable polymer is selected from the group consisting of alginate, pectin, carrageenan, modified polysaccharides with cross-linkable functional groups, and combinations thereof.

4. The pre-portioned product of claim 3, wherein said cross-linkable polymer comprises pectin.

5. The pre-portioned product of claim 1, wherein the coating further comprises at least one non-tobacco flavorant and an optional emulsifier (a) incorporated in the water-soluble component so as to provide rapid release; (b) incorporated in the substantially water-insoluble component so as to provide prolonged release; or (c) incorporated in both the substantially water-insoluble and water-soluble components so as to provide slow release and prolonged release.

6. The pre-portioned product of claim 1, wherein said coating further comprises:

a) at least one sweetener;

b) at least one chemesthesis agent;

c) a tobacco extract, d) at least one vitamin;

(e) at least one nutraceutical;

(f) at least one mineral;

(g) at least one botanical extract; and/or (h) at least one amino acid;

wherein said at least one sweetener, said at least one chemesthesis agent; said tobacco extract, said at least one vitamin, said at least one nutraceutical, said at least one mineral, at least one botanical extract, and/or said at least one amino acid are released when said soluble component dissolves.

7. The pre-portioned product of claim 1, wherein said tobacco material includes at least one humectant.

8. The pre-portioned product of claim 1, wherein said collection of particles of plant material is completely disintegrable into individual particles in the oral cavity of a user.

9. The pre-portioned moist tobacco product of claim 1, wherein said pre-portioned product is a moist smokeless tobacco product having an individual portion that weighs about 1.0 g to 4.0 g and wherein the product is moist, soft, and flexible so as to conform to the shape of an oral cavity when placed therein.

10. The pre-portioned product of claim 1, wherein the coating includes a water-soluble, non-cross-linkable polymer and a water-insoluble, cross-linked polymer wherein the coating contains a minority amount of the cross-linked polymer.

11. The pre-portioned product of claim 1, wherein the water-soluble, non-cross-linkable component comprises a starch and the substantially water-insoluble, cross-linked component comprises pectin.

12. The pre-portioned product of claim 1, wherein the coating is formed by contacting a shaped mass of the plant material with an aqueous coating solution comprising the water-soluble, non-cross-linked component an amount of about 15% to about 30% by weight based on the weight of the coating solution and the substantially water-insoluble, cross-linked component in an amount of about 0.3% to about 1.5% by weight based on the weight of the coating solution.

13. A method of forming a pre-portioned product for oral enjoyment having a semi-dissolvable coating, the method comprising:

forming a portion of plant material particles to form a pre-portioned plant material;

contacting said portion of pre-portioned plant material with a multi-component aqueous coating solution comprising a water-soluble, non-cross-linkable polymer included in an amount of about 15% to about 30% by weight based on the weight of the coating solution and a cross-linkable polymer which forms a substantially water-insoluble polymer upon cross-linking included in an amount of about 0.3% to about 1.5% by weight, based on the weight of the coating solution, to form a coating on said portion of plant material; and contacting the coating with a cross-linking solution including a cross-linking agent in an amount of about 0.5 wt % to about 2.0 wt % based on the total weight of the cross-linking solution to cross-link said cross-linkable polymer and form a semi-dissolvable, coating on the surface of the pre-portioned plant material, wherein the resulting coating contains a minority amount of the cross-linked polymer.

14. The method of claim 13, wherein said chemically, cross-linkable polymer and said non-cross-linkable polymer are polysaccharides.

15. The method of claim 13, wherein said cross-linkable polymer is selected from the group consisting of alginate, pectin, carrageenan, modified polysaccharides with cross-linkable functional groups, and combinations thereof.

16. The method of claim 15, wherein the cross-linking agent comprises a bivalent metal ion salt.

17. The method of claim 16, wherein said bivalent metal ion salt is calcium lactate.

18. The method of claim 16, wherein: the contacting comprises (a) spraying the molded portion of plant material with said polymer solution;

or (b) dipping the molded portion of plant material into said polymer solution; and wherein the cross-linking agent is applied to the coating in a pattern and/or the plant material comprises tobacco.

* * * * *